US006161269A

United States Patent [19]

Dilo et al.

[11] Patent Number: 6,161,269

[45] Date of Patent: Dec. 19, 2000

[54] APPARATUS FOR NEEDLING NON-WOVEN FIBER FLEECE WEBS

[75] Inventors: Johann Philipp Dilo; Joachim Leger, both of Eberbach, Germany

[73] Assignee: Oskar Dilo Maschinenfabrik KG, Eberbach, Germany

[21] Appl. No.: 09/098,245

[22] Filed: Jun. 17, 1998

[30] Foreign Application Priority Data

Jul. 16, 1997 [DE] Germany ..... 197 30 532

[51] Int. Cl.[7] ..... D04H 18/00

[52] U.S. Cl. ..... 28/114; 28/107

[58] Field of Search ..... 28/107, 108, 109, 28/110, 111, 112, 113, 114, 115; 112/80.4, 80.42, 80.45, 271

[56] References Cited

U.S. PATENT DOCUMENTS

| | | | |
|---|---|---|---|
| 3,508,307 | 4/1970 | Dilo . | |
| 5,144,730 | 9/1992 | Dilo . | |
| 5,390,556 | 2/1995 | Nencini et al. | 28/113 |
| 5,473,802 | 12/1995 | Dilo . | |
| 5,548,881 | 8/1996 | Ludwig | 28/113 |
| 5,732,453 | 3/1998 | Dilo . | |

*Primary Examiner*—John J. Calvert
*Assistant Examiner*—Larry D. Worrell, Jr.
*Attorney, Agent, or Firm*—Ostrolenk, Faber, Gerb & Soffen, LLP

[57] ABSTRACT

A drive apparatus for the needle bar of a needle machine includes a first drive mechanism connected with the needle bar and which applies a first movement component extending perpendicular to the needle bar, a second drive mechanism connected with the needle bar which applies second movement component parallel to the needle bar, and an additional mechanism for varying the movement stroke of the parallel component. Two eccentric shafts are assigned to the second drive mechanism, these eccentric shafts being driven at the same speed and the eccentric sections of which having a connecting rod supported thereon converting the rotating movement of the associated eccentric section into a linear oscillating movement. The two linear oscillation movements are supplied to a coupling bridge at two first and second hinge points spaced apart from one another. The coupling bridge is coupled with the needle bar or a carrier thereof at a third hinge point arranged between the first and second hinge points. The additional mechanism for varying the movement stroke of the horizontal component varies the rotary angle position of the two eccentric shafts with respect to one another.

34 Claims, 10 Drawing Sheets

APPARATUS FOR NEEDLING NON-WOVEN FIBER FLEECE WEBS

BACKGROUND OF THE INVENTION

The present invention refers to a needle machine for needling non-woven fiber fleece webs, comprising at least one support for supporting a fiber fleece web to be needled, at least one movable needle bar equipped with a plurality of needles, said needle bar being put into an oscillating movement, and comprising a drive for the needle bar, containing a first drive means connected to the needle bar and providing the needle bar with a movement component (vertical component) extending perpendicularly to the support, a second drive means connected to the needle bar and providing the needle bar with a movement component (horizontal component) extending in parallel to the support, and a means for changing the movement stroke of the horizontal component. Such a machine is known from U.S. Pat. No. 5,732,453 to Dilo et al., the disclosure of which being incorporated by reference into this description.

When needling a fiber fleece web in a needle machine, in which the needle bar performs a movement that is only directed perpendicularly to the fiber fleece web to be needled, the fiber fleece web continuously transported through the needle machine by supply and take-up rollers mounted in a frame of the needle machine is braked by the needles during the period within which the needles are stitched into the fiber fleece. This leads to the fiber fleece being deformed and the needles being resiliently bent in cyclically recurring cycles. These effects are disadvantageous for the fiber fleece and the needle machine. This could be prevented in that at a given stroke frequency of the needle bar, the transport speed of the fiber fleece web through the needle machine was reduced. This, however reduced productivity. In particular in when manufacturing machine felts that have great lengths and widths, a great transport speed is required for an economic manufacture. Deformation of the fiber fleece may result in an irregularity of the fiber fleece surface, which later becomes visible in the paper that is manufactured by the aid of this fleece or felt.

To avoid these disadvantageous effects, a second drive is associated to the needle bar according to the above-mentioned U.S. Pat. No. 5,732,453, said second drive setting the needle bar cyclically and synchronously to said first drive in a motion (horizontal motion) oscillating parallel to the fiber fleece web with its stitching direction (vertical direction) extending perpendicular to the fiber fleece. The horizontal movement extends in and opposite to the transport direction of the fiber fleece web through the needle machine and is superimposed in time by the perpendicular stitching-in movement of the needle bar such that the movement of the needle bar in the horizontal direction in the time section of each motion cycle in which the needles are stitched into the fiber fleece follows the movement of the fiber fleece through the needle machine caused by the supply and take-up rollers, whereas in the condition of the needles released from the fiber fleece, the return of the needle bar takes place in the horizontal direction, i.e. in parallel to the fiber fleece web into the starting position. Thus, the needle bar, seen from the side transversely to the transport direction of the fiber fleece web, performs a circulating movement, which according to the relation of the strokes of the horizontal and vertical movements is more or less circular or elliptical.

Frequently, the desire arises to change the stroke of the horizontal movement of the needle bar in a needle machine equipped in that manner, e.g. to adapt said stroke to the transport speed of the fiber fleece through the needle machine. The above-mentioned U.S. Pat. No. 5,732,453 provides a solution for this purpose in which the eccentricity of a rotating eccentric by means of which the horizontal motion component of the needle bar is caused, can be changed. The means provided for that purpose are rotatable bushings and associated coupling means. This solution is mechanically quite difficult and enables adjustments only by means of time-consuming works and only between a few positions and moreover only during standstill of the machine.

SUMMARY OF THE INVENTION

The object of the invention is to provide a needle machine, in which the stroke of the movement directed transversely to the stitching-in movement, which is forced on the needle bar by the second drive means, is easily adjustable in a fine gradation, preferably also infinitely.

The invention provides a needle machine for needling non-woven fiber fleece webs, comprising at least one support for supporting a fiber fleece web to be needled, at least one movable needle bar equipped with a plurality of needles, said needle bar being set into an oscillating motion, and a drive for the needle bar, containing a first drive means connected with the needle bar and which provides the needle bar with a movement component (vertical component) extending perpendicularly to the support, a second drive means, connected to the needle bar and providing the needle bar with a movement component (horizontal component) extending in parallel to the support, and a means for changing the movement stroke of the horizontal component, in which two eccentric shafts are associated to the second drive means, said eccentric shafts being driven at the same speed and each of which comprises an eccentric section on which a connection rod is supported which converts the circumferential movement of the associated eccentric section into a linearly oscillating movement, wherein a coupling bridge is provided, to which the two linear oscillation movements of the connection rods are supplied at two first and second hinge points spaced toward one another and which comprises a third hinge point located between the first and the second hinge points, said third hinge point being pivotally connected with the needle bar by means of a coupling arrangement, and in which the means for changing the movement stroke of the horizontal component consists of a control means, which acts on the second drive means in a manner that a mutual rotary angle position of the two eccentric shafts is changed.

A further solution of the object is provided by a needle machine of the above mentioned kind, in which the second drive means comprises an eccentric shaft having an eccentric section on which a connecting rod is rotatably supported, which has a free end that is pivotally connected to a first leg of a rocker arm at a first hinge point, wherein a second leg of the rocker arm is pivotally supported at a second hinge point in a frame of the needle machine, wherein a third hinge point located between the first and second hinge points of the rocker arm is pivotally connected with the needle bar by means of a link extending substantially parallel to the support of the fiber fleece web to be needled in the needle machine, and wherein the first hinge point has a distance to the second hinge point that is adjustable along the first leg of the rocker arm.

Advantageous embodiments of the invention will be described later with reference to the drawings.

It must be emphasized that when the description and the claims state that the second drive means is coupled with the needle bar, this also includes that the coupling is possibly carried out at a carrier holding the needle bar.

A first concept of the invention provides two eccentric shafts for the second drive means, said two eccentric shafts rotating at the same speed and the connecting rod motions caused by them being combined at a coupling bridge. By varying the rotary angle position of the eccentric shafts against one another, it can be achieved that the effects of the connecting rod motions at a hinge point of the coupling bridge that is coupled to the needle bar, more or less add up to one another or subtract from one another or are almost compensated.

In a second concept of the invention, an eccentric movement of the second drive means through a connecting rod and through a pivotally supported rocker arm coupled to the connecting rod is converted into an almost linear, reciprocating movement, the stroke thereof being variable by varying the length of the rocker arm by means of which the connecting rod is effective at the rocker arm.

BRIEF DESCRIPTION OF THE DRAWINGS

The invention will now be described with reference to the drawings.

The drawings only show the essential parts of a needle machine, as far as they are necessary for explaining the invention. Superfluous features are not shown for clarity's sake.

Explanation of Preferred Embodiments

Figure 1:
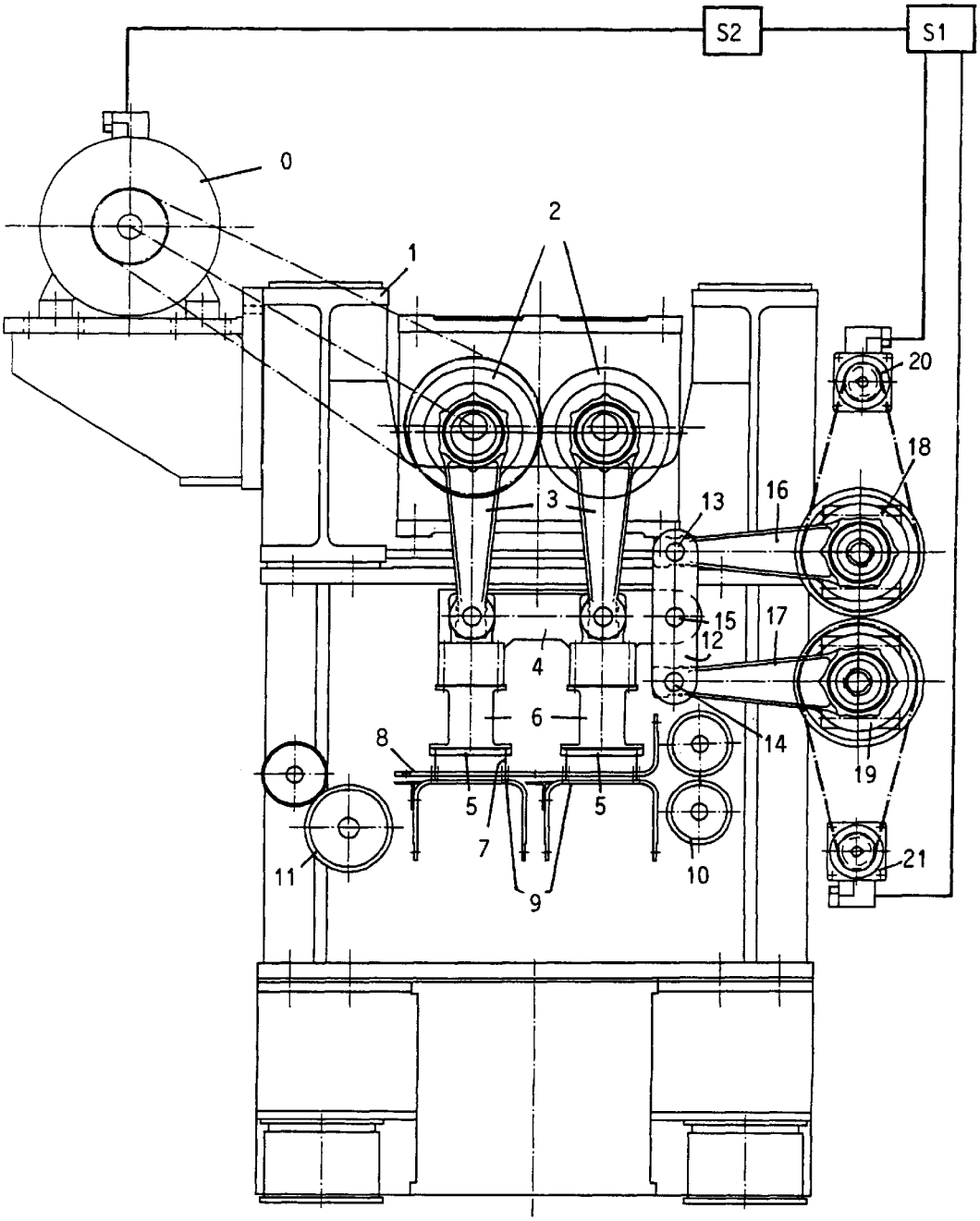
FIG. 1 shows a first embodiment of the invention following the first concept.

FIG. 1 is a lateral view of a needle machine, the view being simplified in the above-mentioned sense. Two eccentric drives 2 are arranged in a machine frame 1. These two eccentric drives, in turn driven by means of a main motor O through belts, chains or similar drive connections, can drive a needle bar carrier 4 in reciprocating motion via connecting rods 3. Two needle bars 6 each equipped with needle boards 5 are attached at the needle bar carrier 4. Only some of the needles 7 attached at the needle boards 5 are shown. The two eccentric drives 2 are preferably connected by means of a gearing, i.e. through a spur wheel stage (not shown) to secure a synchronously opposite rotary motion of the eccentric drives.

The needles 7 stitch through a stripper plate 8 into a fiber fleece web (not shown) located on a support 9. The fiber fleece web in the example shown is transported by means of driven supply and take-up rollers 10 and 11, respectively through the needle machine.

At a plurality of locations distributed transversely to the transport direction of the fiber fleece through the needle machine, coupling bridges 12 are attached at the needle bar carrier 4. One coupling bridge only is shown in FIG. 1. The coupling bridges 12 each comprise three hinge points, namely first and second hinge points 13 and 14 at the ends and a third hinge point 15 in the center thereof. At the third hinge point 15 the coupling bridges 12 are each connected with the needle bar carrier 14, whereas at the first and second hinge points 13 and 14, the free ends of connecting rods 16 and 17 are connected, which are supported on eccentrics 18 and 19 arranged on one side of the needle machine and which are driven by said eccentrics. The shafts of the eccentrics 18 and 19 are driven by servo motors 20 and 21 via belts, chains and other suitable power transmission means.

The servo motors, eccentrics, connecting rods and coupling bridges represent the second drive means of the needle bars.

It can be recognized from the drawing, that when the eccentrics 18 and 19 are adapted in their mutual angular position in a manner that the connecting rods 16 and 17 are simultaneously moved to the right and left, i.e. at equal phase, the ends connected to the hinge points 13 and 14 cause equal effects at the coupling bridge 12 and therefore reciprocate the needle bar barrier 4 in the horizontal direction. If, however, the angular positions of the eccentrics 18 and 19 are adapted such that the movements of the connecting rods 16 and 17 are counter-phased, the effects caused by the connecting rods 16 and 17 at the coupling bridge are compensated in the hinge point 15. The coupling bridge 12 is merely reciprocatingly pivoted about the hinge point 15, so that no horizontal movement is exerted onto the needle bar carrier 4.

It can be taken from the description of these two extreme cases, that by infinitely adjusting the mutual rotary phase positions of the eccentrics 18 and 19, the horizontally aligned movement component resulting in hinge point 15 can be varied. This variation can be carried out by simply adjusting the mutual phase positions of the servo motors 20 and 21 driving the eccentrics. A first control means provided for that purpose is schematically shown by S1 in FIG. 1.

It must be emphasized that the timing of the horizontal movement component caused by the eccentrics 18 and 19 at the hinge point 15 with respect to the vertical movement component caused by the eccentrics 2 can be influenced if desired by varying the rotary phase position of the drives of the eccentrics 18, 19 with respect to the rotary phase position of the drive of the eccentrics 2. A second control means provided for that purpose is schematically shown by S2 in FIG. 1.

For influencing the phase positions of all rotating shafts, an advantageous solution provides to detect the rotary angle positions of the shafts by means of angle transmitters arranged at the shafts in a known manner, and to control the power supply to electric motors driving the shafts by means of the output signals of said angle transmitters in a manner that the desired mutual phase relation of the rotary angle positions of the shafts are achieved. For this purpose, known closed loop controls can be used, which operate on the basis of a target/actual comparison. The closed loop controls are generally known and do not have to be described in detail.

As an alternative, the rotary angle positions of the motor shafts could also be detected by angle transmitters, but then the power transmission means to the eccentric shafts have to be provided in positive fit, and eventually existing speed gear ratios in the power transmission from motor to eccentric shafts have to be taken into consideration.

A special advantage of the above described solution is that the adjustment of the stroke of the horizontal movement of the needle bar can be carried out in running operation of the machine, thus saving time, without any disassemblies becoming necessary. Moreover, it can be carried out infinitely variably.

It is also possible to refrain from using one of the drive motors 20 and 21 and instead to mechanically couple the two eccentrics 18 and 19, e.g. through a toothed gearing which has to be engageable and disengageable for changing the mutual rotary angle positions of the eccentrics. It could then be refrained from using the associated control means. By this specification, the person skilled in the art is provided with sufficient ideas so that a detailed description is not necessary.

It is self-evident that the stripper plate 8 and the support 9 for the fiber fleece web have to take the horizontal movement component of the needles into consideration. In the stripper 8, which consists of a punched plate, the openings for the passage of the needles 7 are thus formed as slots longitudinally extending in the direction of the horizontal movement component of the needle bar 4. The support 9 can be formed in the same manner as the stripper 8 plate. Such solutions in particular apply for double needle machines, in which the fiber fleece web is needled from both sides.

An alternative of a support in machines needling from one side could be a known brush band which moves along with the fiber fleece web and carries same. This alternative is not shown here and does not have to be explained, since it is known to the person skilled in the art, e.g. from U.S. Pat. Nos. 5,144,730 (Dilo) and 5,473,802 (Dilo).

Figure 2:
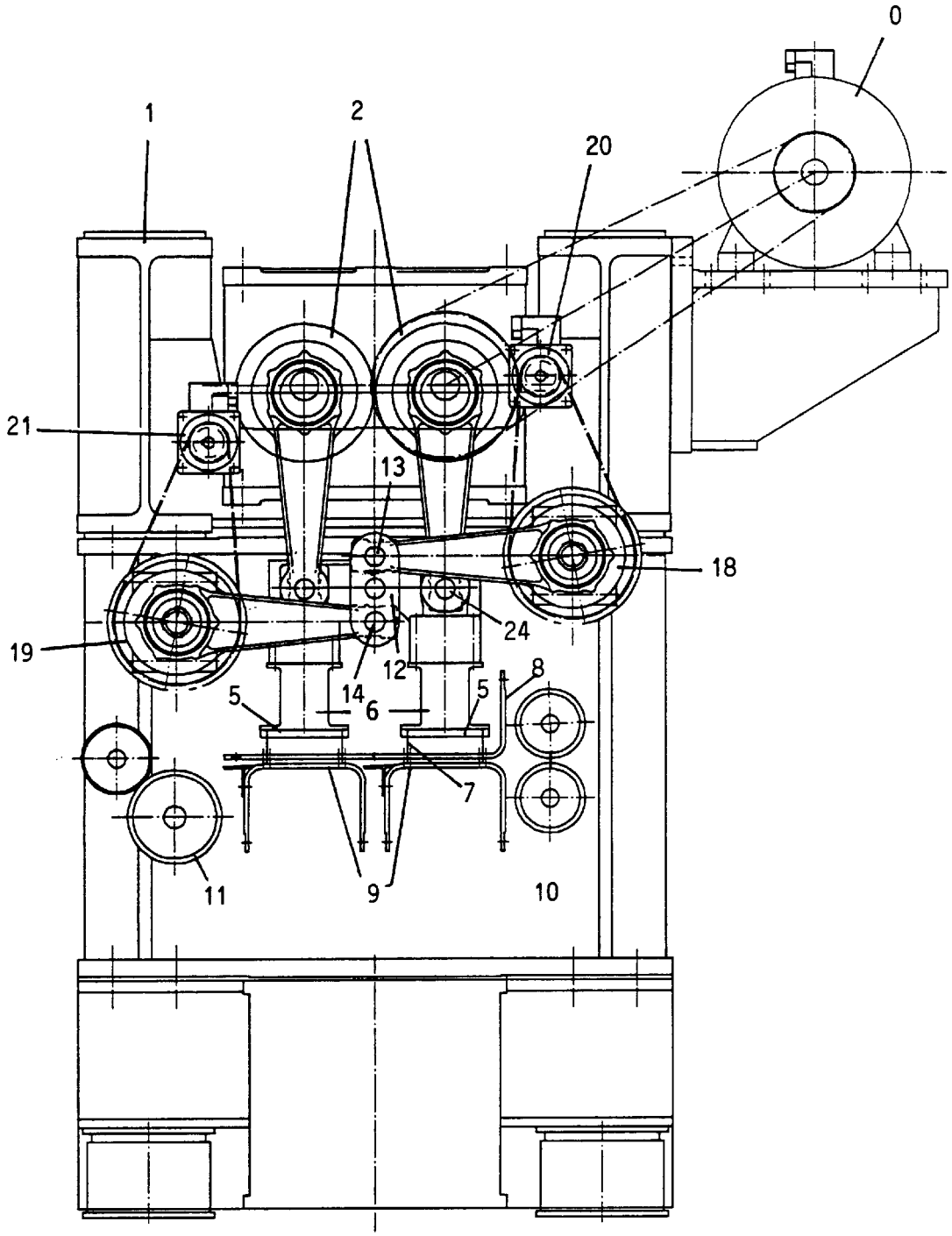
FIG. 2 shows a second embodiment of the invention following the first principle.

FIG. 2 shows a second embodiment of the invention, which is very similar to that of FIG. 1 and which differs from that of FIG. 1 only in that the two eccentrics 18 and 19 are arranged on different sides of the two needle bars 6. The structure of this machine is, as can be taken from the drawing, slightly more compact compared to that of FIG. 1. Regarding the function, changes cannot be seen, so that a detailed description is not necessary.

Figure 3:
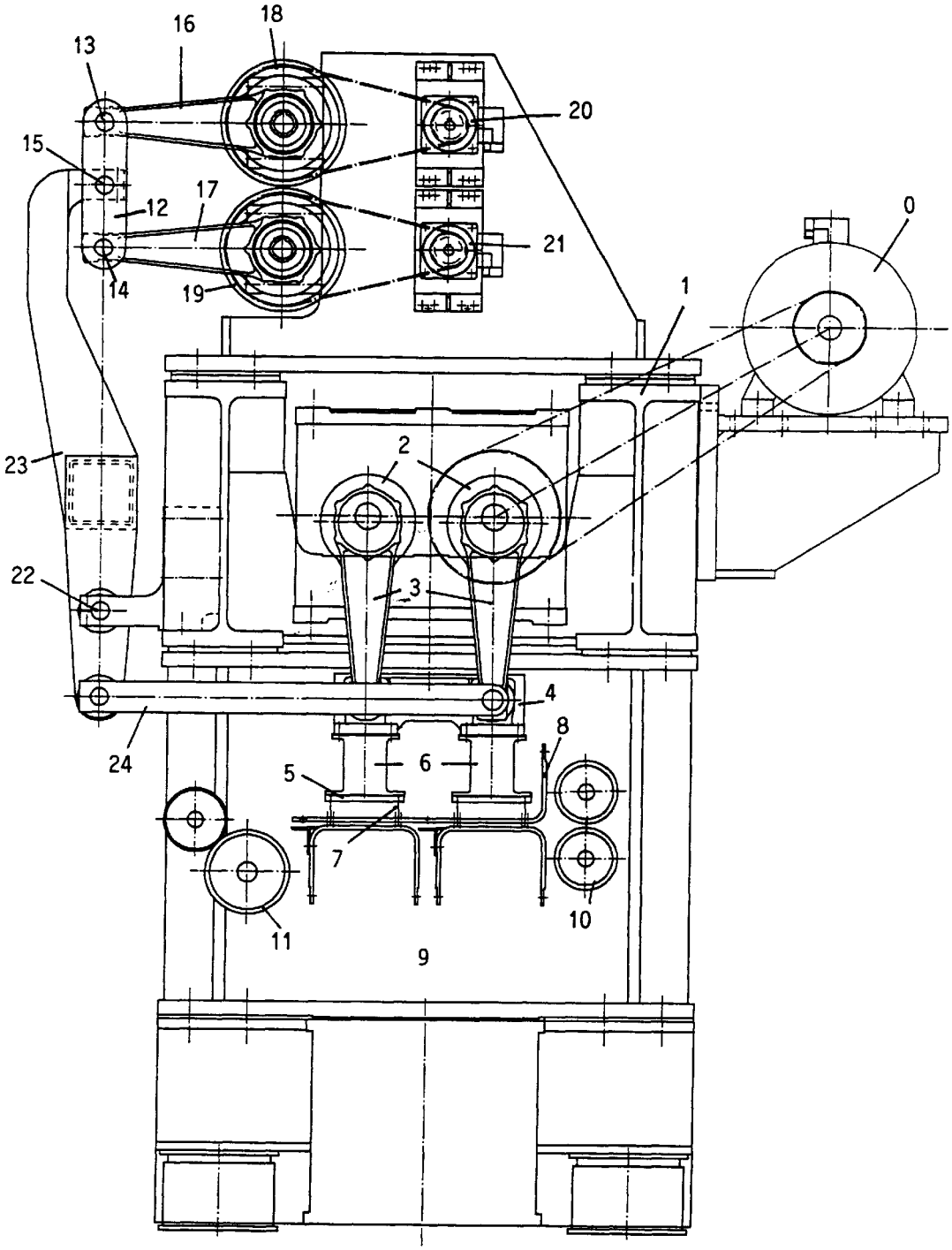
FIG. 3 shows a third embodiment of the invention following the first principle.

FIG. 3 shows an embodiment of the invention, in which the eccentrics 18 and 19 of the second drive means are arranged above the needle machine, i.e. at the head thereof. This embodiment is especially interesting in applications in which the assembly space for the needle machine is limited but in which there is sufficient assembly space above the needle machine.

The connecting rods 16 and 17 of the eccentrics are again at their free ends coupled at hinge points 13 and 14 of a coupling bridge 12 which comprises a third hinge point 15, which, however, in this case is coupled to the needle bar carrier 4 through a rocker arm 23 pivotally supported at 22 at the machine frame 1, and through a link 24 pivotally connected to the rocker arm and to the needle bar carrier 4. It can be seen that the resulting motion of the connecting rods 16 and 17 at the hinge point 15 is transferred via the rocker arm 23 and the link 24 to the needle bar carrier 4 and provides it with a horizontal movement component, i.e. a component that extends perpendicularly to the stitching-in movement of the needles. The setting of the rotary angle positions of the eccentrics 18 and 19 with respect to one another and with respect to the rotary angle positions of the first eccentrics 2 is as in the above-described embodiments, so that explanations in this respect are not necessary.

Figure 4:
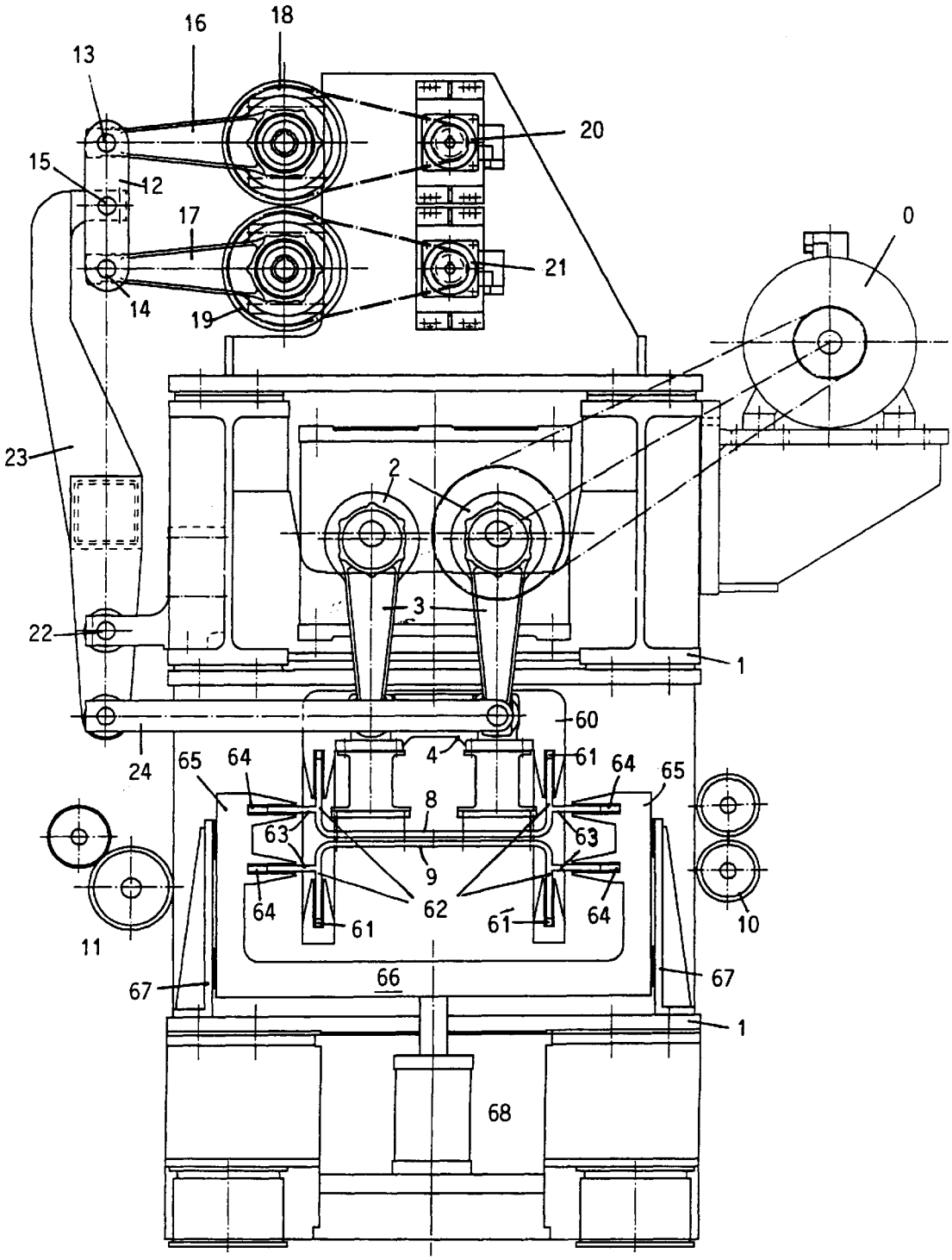
FIG. 4 is an alternative to FIG. 3.

A further alternative is to couple the stripper plate 8 and the support 9 to the second drive means in a manner that they follow the horizontal movement of the needle bar at equal phase. This coupling can favorably be effected directly at the needle bar carrier. This alternative is shown in FIG. 4.

According to the alternative, first guide links 60 including first guide slots 61 extending perpendicularly to the support are attached at the needle bar carrier 4 at the fleece web intake side and outlet side of the needle machine. In the guide slots 61, bent-open ends 62 of the stripper plate 8 and of the support 9 are guided in the vertical direction, i.e. perpendicularly to the fleece web to be needled. Horizontal guide flanges 63 extend from the stripper 8 plate and the support 9 towards the intake side and outlet side, said guide flanges each being guided in second guide slots 64, which are provided in the second guide links 65 retained in the machine frame. These second guide slots 64 determine the clearance of stripper plate 8 and support 9 and permit a horizontal movement of stripper plate 8 and support 9. The second guide links 65 may possibly be adjustable perpendicularly. This will be discussed in detail later on.

In operation, the stripper plate 8 and the support 9 follow the horizontal movement of the needle bar carrier 4 due to the rigid coupling of the first guide links 60 with the needle bar carrier 4, wherein the guide flanges 63 slide in the second guide slots 64. However, the stripper plate 8 and the support 9 do not follow the vertical movement of the needle bar carrier 4, since they are prevented therefrom by the guide flanges 63 located in the second guide slots 64. The perpendicular movement of the needle bar carrier 4 is not interfered by the stripper plate 8 and the support, since their bent-up ends 62 slide in the first guide slots 61.

Figure 5:
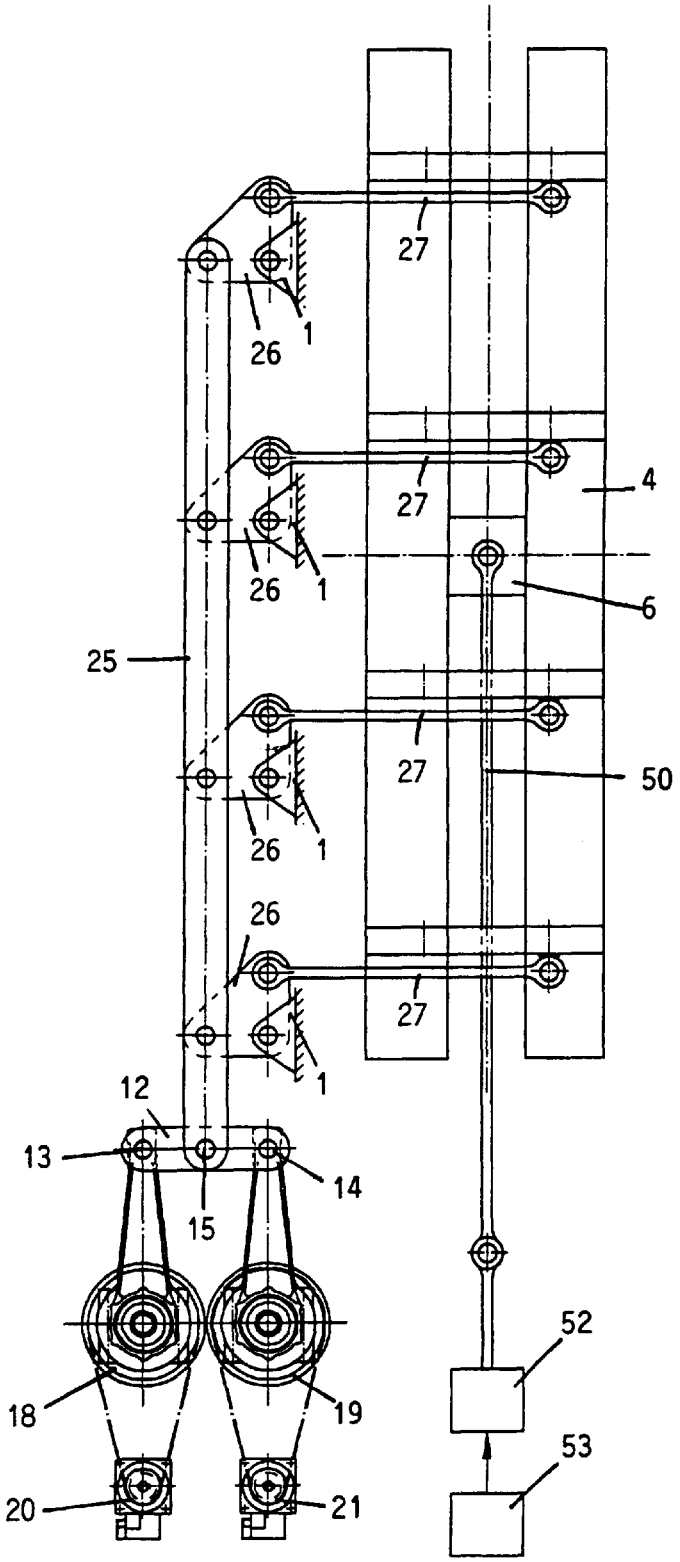
FIG. 5 is a scheme for explaining the power transmission to the needle bar in the first concept of the invention and at the same time a principle representation of a drive for the generation of a lateral offset of the needle bar.

FIG. 5 schematically shows a top view onto the needle bar area of a needle machine. Needle machines sometimes have a very large working width that may comprise a plurality of meters. In order to avoid the disadvantageous influences of the mass inertia that could lead to resilient bending of the needle bar, if the driving power is provided to the needle bar at one location only, according to FIG. 5, the horizontal movement component is supplied to the needle bar at a plurality of locations distributed along its extension. In FIG. 5, elements corresponding to the above described examples are provided with the same reference numerals, so that they do not have to be explained again. It can be seen that starting out from the hinge point 15 of the coupling bridge, the movement caused by the eccentrics 18 and 19 is transferred through a transverse bar 25 and a plurality of rocker arms 26 as well as by a respective number of longitudinal links onto the needle bar carrier. This construction principle can easily be transferred onto the embodiment according to FIG. 3 as well.

In the embodiments according to FIG. 1 and 2, a plurality of eccentrics arranged on a common shaft and aligned the same way having a respective number of connecting rods have to be provided along the needle bar carrier 4, said connecting rods engaging the needle bar carrier through a plurality of coupling bridges.

Usually, the fiber fleece web is transported at constant speed through the machine by means of supply and take-up rollers 10 and 11 (FIG. 1) in a needle machine from which the invention starts out. The invention described in the above-mentioned U.S. Pat. No. 5,732,453 to Dilo et al. starts out from the problems caused by constant speed, which in particular aggravate of the fleece web is transported at high speed. By means of a follow-up motion of the needle bar in the horizontal direction caused by eccentric shafts of the second drive means driven at constant rotary speed, these problems can be eliminated to a sufficient extent in most cases.

However, this follow-up motion in the horizontal direction has a speed course, that is sine-like, i.e. the horizontal speed of the needle bar gradually increases from zero, reaches a maximum and then decreases again to zero to subsequently reverse direction for the return motion of the needle bar and so forth. Thereby, deviations of the speed of the horizontal movement of the needles carried by the needle bar from the speed of the feed motion of the fleece web penetrated by the needles occur, which could lead to undesired interference in the structure of the manufactured product, if for instance felts of a special degree of fineness and regularity are to be manufactured, such as paper machine felts.

The solution for this problem that the invention describes according to a further embodiment is to control the servo motors of the second drive means in a cyclically running program such that the previously mentioned sine-like speed profile of the horizontal motion of the needle bar is smoothened to a regular speed at least during the horizontal motion stroke that follows the fleece feed direction. Modern control electronics allows to influence the rotary speed of servo motors in this manner.

If lighter fleece webs are treated, it is also possible to refrain from using the supply and take-up rollers directly assigned to the needling zone of the needle machine or to make the gaps formed between the roller pairs wider than the thickness of the fiber fleece web and thereby to transport the fleece web only by the needles stitched therethrough by means of the horizontal movement of the needle bar through the needling zone caused by the second drive means. A sine-shaped course of the horizontal movement of the needle bar is advantageous in this case, since thereby a "dragging" at the fiber fleece web by means of the needles during acceleration in the horizontal direction is prevented.

By means of the measures according to the invention, which enable a complete adaptation of the needle movement in the horizontal direction to the respective needs, a considerable increase of quality of the product manufactured is achieved. A further quality increase by evening out or blurring the stitching pattern can be achieved when the needle bar is laterally displaced between successive stitching movements, i.e. transversely to the fleece feed direction, about less than a lateral needle spacing. A drive scheme for producing such a lateral displacement movement of the needle bar is also shown in FIG. 5.

According to FIG. 5, a second transverse link 50 is attached by means of a cross joint 51 approximately in the center of the longitudinal extension of a carrier 4 carrying two needle bars 6, said transverse link 50 extending in the longitudinal direction of the needle bars 6 from the needling zone and being connected with an actuator motor 52, which may be for instance an electric linear motor or a servo-hydraulic drive means. By means of this actuator motor 52, the needle bar carrier 4 is adjustable through the second transverse link 50 transversely to the feed direction of the fleece web, preferably in a plurality of steps.

It is self-evident that the hinge connections between the connecting rods 3 and the needle bar carrier 4 in this case have to be designed such that they allow this transverse movement of the needle bar carrier 4. The bearings of the connecting rods 3 on their eccentrics also have to allow a slight lateral pivot movement of the connecting rods 3. For this purpose, spherical roller bearings can be used.

The control of the actuator motor 52 is carried out in the phase of the vertical movement of the needle bar carrier 4 in which the needles are not stitched into the fleece web. The amount of the movement that has to be caused by the actuator motor 52 is relatively small. In accordance with a lateral distance between needle adjoining one another of usually 3 mm, it is maximally slightly below 3 mm. This amount of movement is preferably divided into a plurality of steps, e.g. into two steps so that each needle stitching position is adjustable between three lateral positions, a left, a central and a right position, seen in the fleece feed direction. These positions may be used cyclically, wherein e.g. selectively after each needle stitch-in or after a predetermined number of needle stitch-ins into the fleece web, the position is changed by means of the actuator motor 52. The appropriate control of the actuator motor 52 is therefore carried out in accordance with the working cycle of the eccentric drives 2 and may in particular be carried out through the angle transmitters and clock counters possibly installed there. The control of the actuator motor 52 may preferably be carried out through a control generator 53, which works a cyclic program, or which outputs a stochastic random order of control commands for the actuator motor 52.

However, it is also possible to form the actuator from a rotating eccentric and a cam follower sliding thereon, wherein the eccentric is driven by the main motor O of the needle machine.

Figure 6:
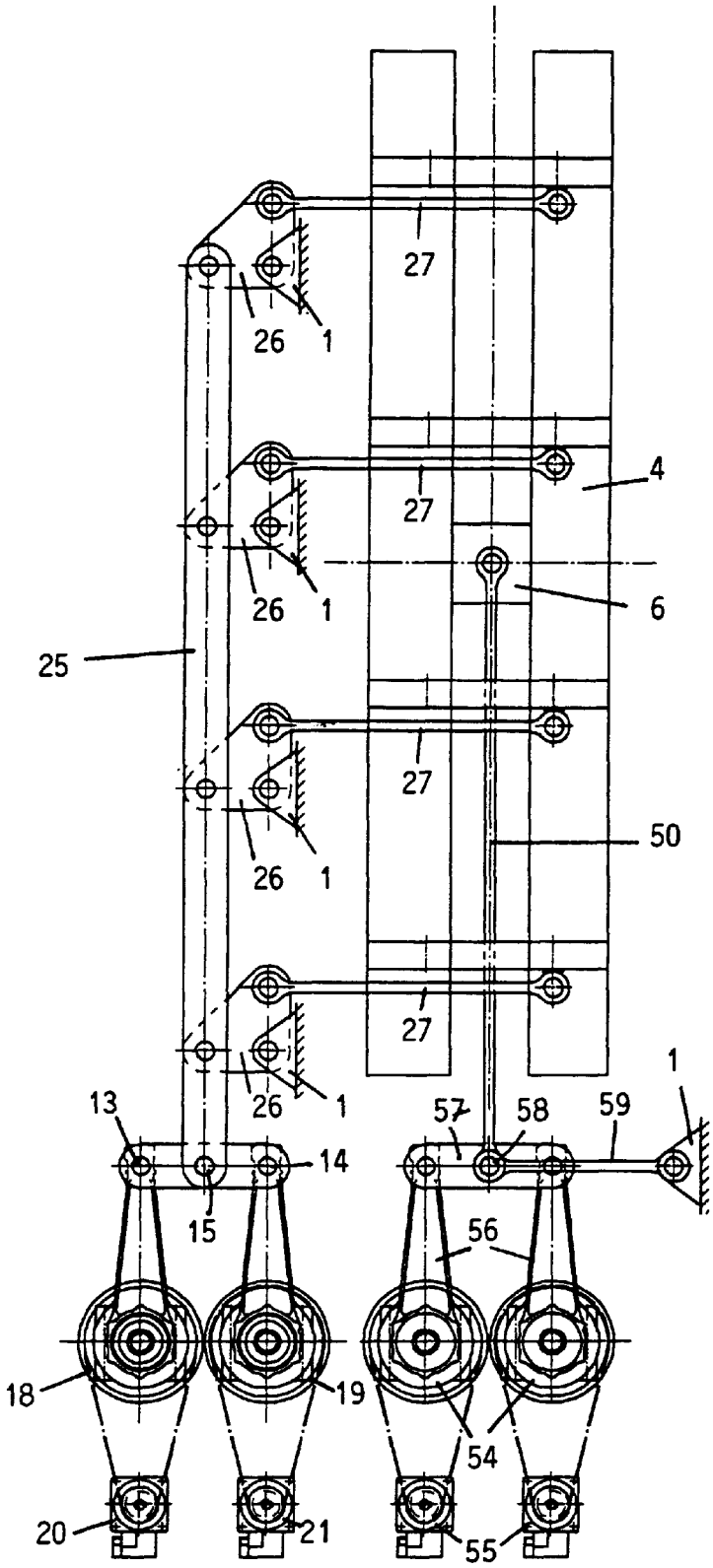
FIG. 6 is an alternative embodiment of the drive for the lateral offset of the needle bar.

A further alternative, which is shown in FIG. 6, is to form the actuator 52 by an eccentric drive consisting of two eccentrics 54 that are driven independently from one another by drive motors 55 and which have connecting rods 56 coupled to the ends of a coupling bridge 57. The coupling bridge 57 is pivotally coupled with the second transverse link 50 at a central hinge point 58. The central hinge point 58 is guided in the machine frame 1 through a longitudinal link 59.

Comparable to the above-mentioned second drive means, which ends in the coupling bridge 12, the stroke of the transverse link 50 can be controlled by controlling the phase positions of the drive motors 55. An illustration of a control means for the drive motors 55 is not necessary. It is comparable with the control means S1. The synchronization with the first drive means can be carried out by a means comparable to the control means S2.

By the lateral displacement of the needle bar carrier 4 in successive stitching cycles caused by the transverse link 50, an evening-out or blurring of the stitching pattern at the product manufactured can be achieved without the use of complicated needle equipment patterns at the needle bar. This aspect of the present invention also applies for needle machines, in which the needle bar does not carry out a movement following the fleece feed movement. Thus, the idea described can also be realized in needle machines of that kind.

It is clear that the stripper 8 plate and the support 9 also have to take the transverse movement of the needle bar 6 into consideration. Either the openings formed therein are made so large that despite the transverse displacement of the needles 7 a collision between the needles 7 and the stripper plate 8 and the support 9 does not occur, or a horizontally movable mounting structure of stripper plate 8 and support 9 is provided and both are coupled with the actuator motor, so that they also follow-up the transverse movement of the needle bar 6.

Now a somewhat different embodiment of the invention, still complying with the first principle, will be described with reference to FIG. 7. This Figure schematically shows only the essential parts of a needle machine around the area of the needle bar drive.

Figure 7:
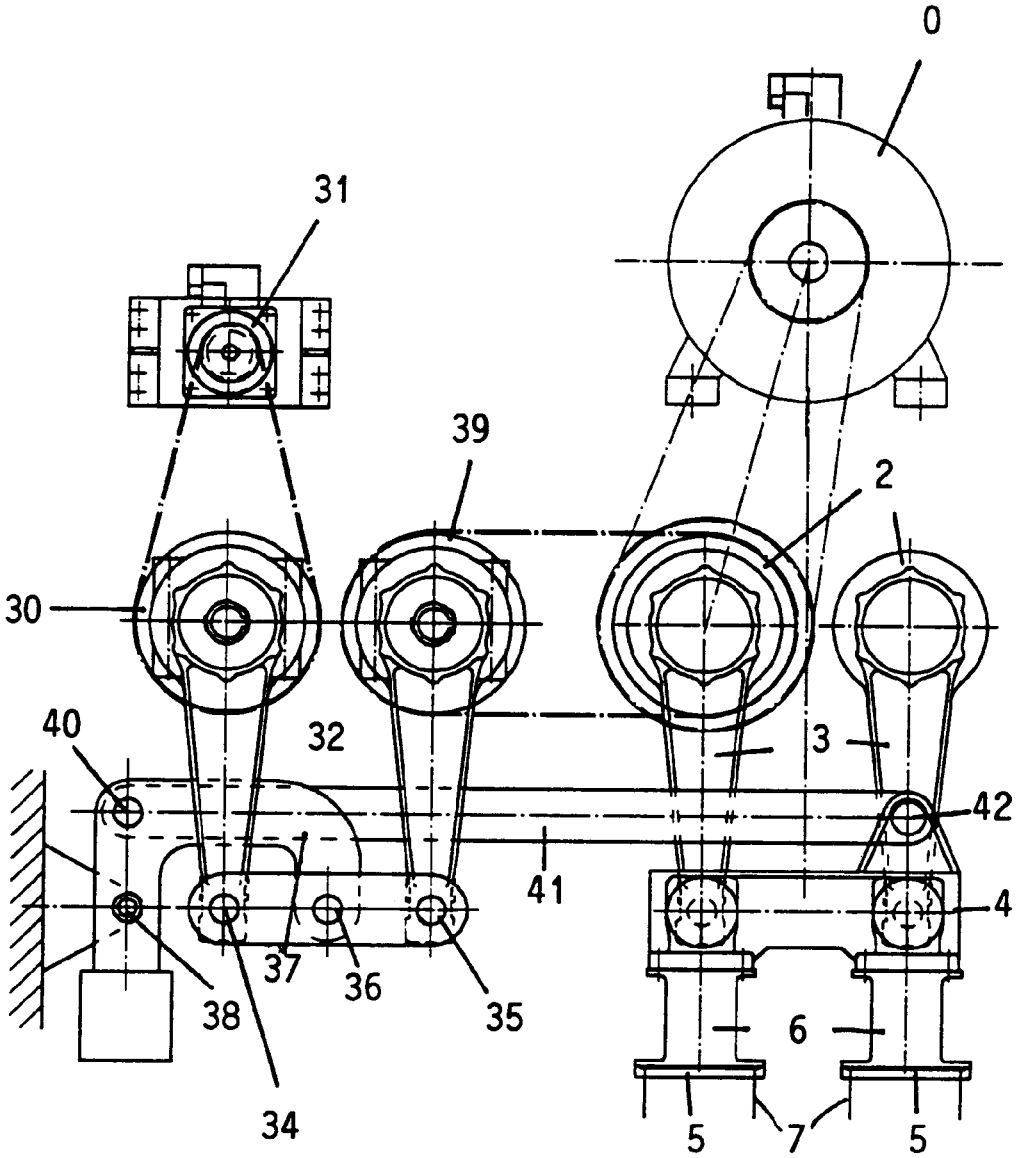
FIG. 7 is a schematic representation of a fourth embodiment of the invention following the first principle.

FIG. 7 shows first eccentrics 2, which displace the needle bar carrier 4 through associated connecting rods into a movement extending perpendicularly to the fiber fleece web to be needled. A second drive is associated to the needle bar carrier 4, said drive consisting of two second eccentrics 30 and 39, the eccentric 30 being rotatably driven by a servo motor via a toothed belt or similar positive power transmission means, and on which a connecting rod 32 is supported, the free end of which being coupled at 34 with one end of a coupling bridge 33. The other one (39) of the second eccentrics is driven at the same frequency through a belt or similar power transmission means by one of the first eccentrics 2. A connecting rod 32 supported at the other second eccentric 39 is on its free end pivotally connected at 35 with the coupling bridge 33 at the other end thereof.

A third hinge point 36 is provided between the end-side hinge points 34 and 35. A rocker arm 37 is attached at the third hinge point 36, said rocker arm 37 being pivotally supported in the machine frame at 38. In the example shown, a hinge point 40 is located in the apex region of the rocker arm 37 between the hinge point 36, where the coupling bridge 33 is coupled, and the pivot bearing 38 of the rocker arm 37. The one end of a link 41 is attached at this hinge point 40 and the other end is pivotally connected at 42 with the needle bar carrier 4. The link 41 extends substantially horizontally, i.e. in parallel to the fiber fleece web to be needled, whereas the pivot bearing 38 of the rocker arm 37 extends approximately perpendicularly below the hinge point 40.

The function of this arrangement is now explained. For this explanation, it is first of all assumed that the eccentrics 30 and 39 move simultaneously and in the same amount downwards. The coupling bridge 33 is moved downwards through connecting rod 32. Thereby, the coupling bridge 33 pivots the rocker arm 37 in clock-wise direction about the pivot bearing 38, so that the hinge point 40 drifts to the right and moves the needle bar carrier 4 to the right through link 41.

If, on the other hand, the movement of the eccentric 30 driven by the independent servo motor 31 is adapted to the movement of the eccentric 39 in such a manner that counter-phase condition prevails, i.e. the hinge points 34 and 35 are simultaneously moved in directions opposite to one another, the pivot movement of the rocker arm 37 is zero and therefore, the excursion of the needle bar carrier 4 in the horizontal direction is zero.

By varying the rotary phase positions of the eccentrics 30 and 39 by appropriate adjustment of the servo motor 31, the stroke of the horizontal movement of the needle bar carrier 4 can therefore be varied. It is clear that the phase relation between the eccentric 2, which causes the vertical movement of the needle bar carrier 4, and the eccentric 39 cooperating in the generation of the horizontal movement of the needle bar carrier 4 are adapted such that the fleece feed movement is not disrupted by the needles 7 stitched into the fleece web.

The essential difference of the embodiment of FIG. 7 compared to the previously described embodiment is that the drive of one of the second eccentrics is coupled with the drive of the first eccentrics, so that only one additional servo motor is required to cause the horizontal movement of the needle bar carrier, but that still an infinite variation of the stroke of this horizontal movement can be achieved.

Figure 8:
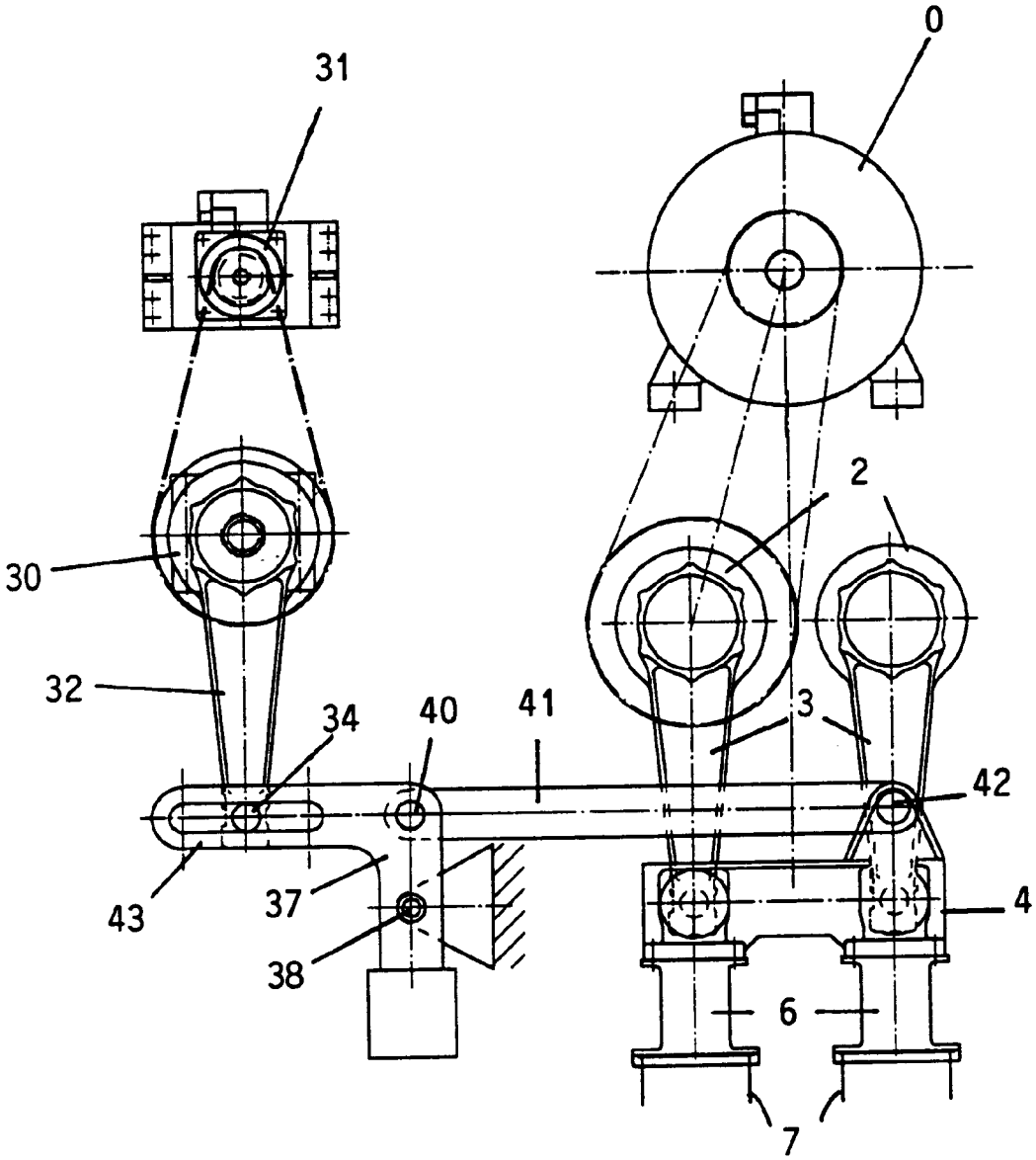
FIG. 8 is a schematic view of the second principle of the invention.

With reference to FIG. 8, the embodiment complying with the second principle will now be described.

As in the embodiment according to FIG. 7, a vertical drive through first eccentrics 2 and a horizontal drive are associated to the needle bar carrier 4. The horizontal drive consists of a second eccentric 30 having a drive motor 31 and a connecting rod 32, as well as a rocker arm 37, which at 38 is pivotally supported in the frame of the needle machine. The free end of the connecting rod 32 is supported in a hinge point 34 at a horizontally extending leg 43 of the rocker arm 37. In the apex of the rocker arm 37, a hinge point 40 is formed at which a link 41 is attached, which extends substantially horizontally, i.e. in parallel to the fleece transporting direction in the needle machine and which is pivotally connected at 42 to the needle bar carrier 4. The hinge point 34 at the apex 43 is adjustable along the legs by means of a device that is not shown here, which is symbolized by a longitudinal slot 44 in the leg 33.

The function of this construction will now be explained. When the eccentric 30 rotates, the connecting rod 32 is set to a reciprocating movement, causing the rocker arm 37 to be set to a reciprocating movement. This reciprocating movement is transferred via link 41 to the needle bar carrier 4. According to the position of the hinge point 34 of the connecting rod 32 along the leg 43 of the rocker arm 37, the pivot movement of the rocker arm 37 is more or less large and thus the horizontal movement of the needle bar carrier 4 is also more or less large.

By varying the timing of the drive of the second eccentric 30 with respect to the timing of the first eccentric 2, the timing of the horizontal movement of the needle bar carrier with respect to the timing of the vertical movement of the same can be varied.

Figure 9:
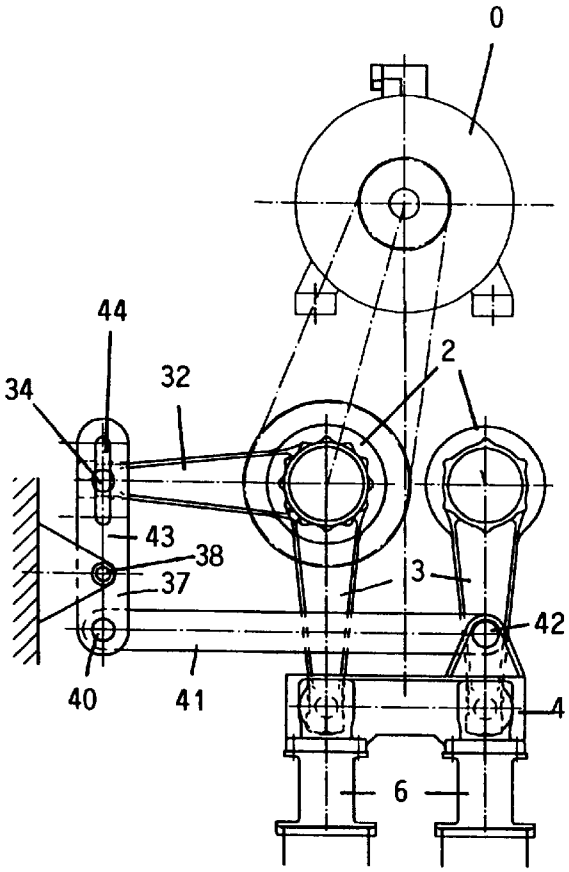
FIG. 9 is a modification of the embodiment of FIG. 8.

FIG. 9 shows a modification of the embodiment according to FIG. 8. Equal elements are designated by the same reference numerals. As far as particularities do not exist, an explanation is not made. The essential difference compared to the embodiment according to FIG. 8 is that the connecting rod 32, which causes the horizontal movement of the needle bar carrier 4, is supported on an eccentric, which is provided on the same axis shaft, as one of the eccentrics 2 which cause the vertical movement of the needle bar carrier 4. This saves the use of a separate drive motor for the generation of the horizontal movement component of the needle bar carrier 4. The rocker arm 37 is extended in this embodiment, i.e. it is not angled as in the previously described embodiments, which is caused by the geometry of the construction shown. Its one leg 43 is again provided with a means (shown in FIG. 9 by a slot 44), by the aid of which the effecting lever length at the hinge point 34, where the connecting rod 32 is attached, can be adjusted to vary the stroke of the horizontal movement component of the needle bar carrier 4.

Figure 10:
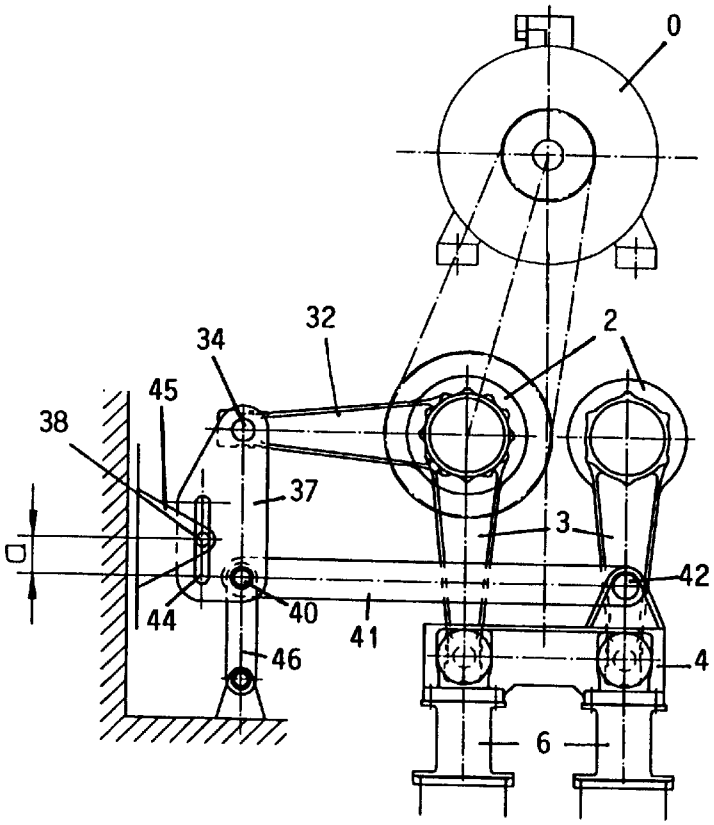
FIG. 10 is a modification of the embodiment of FIG. 9.

The embodiment according to FIG. 10 is very similar to that of FIG. 9. Thus, an explanation of the features already described and complying with FIG. 9 is not necessary. The essential difference with respect to the embodiment according to FIG. 9 is that the pivot bearing 38 of the rocker arm 37 is adjustable along the rocker arm 37, this being illustrated by a slot 44 in the rocker arm 37, in which the pivot bearing 38 supported by a displaceable bracket 45 is adjustable. In order to fix the position of the rocker arm 37, the lower end thereof is supported in the hinge point 40 by means of a link 46 in the machine frame. By adjusting the position of the bracket 45 along the slot 44, the lever lengths between the hinge points 34 and 40 on one hand and the pivot bearing 38 on the other hand are mutually variable, whereby when the movement stroke of the connecting rod 32 is constant, the stroke of the horizontal movement of the link 41 can be varied. A reduction of this stroke to nearly zero is possible when the pivot bearing 38 is moved so close to the hinge point 40 where the link 41 is attached that a pivot movement of the rocker arm 37 by the movement of the connecting rod 32 does not longer cause a noticeable horizontal excursion of the hinge point 40.

For the embodiments according to FIG. 9 and 10, it applies comparably to the embodiment according to FIG. 7, that the angle position of the eccentric driving the connecting rod 32 with respect to the angle position of the eccentrics 2 causing the vertical movement component of the needle bar carrier 4 through the connecting rod 3 is adapted in a manner that the horizontal movement component of the needle bar carrier extending in the fleece web transport direction exists when the needle bar carrier 4 already moved downwards to such an extent that the needles 7 stitch into the fleece web and then continues over the period of time during which the needle bar carrier reaches its lower end position and finally carries out a first portion of its upward movement. The horizontal movement of the needle bar carrier 4 in the fleece web transport direction advantageously already starts before the needles stitch into the fleece web. By adapting the phase relation between the first and the second drive means and possibly by adjusting the clearance of the support 9, the stitching-in moment within the horizontal stroke cycle can be influenced. On the other hand, in the cycle portion of the vertical needle bar movement in which the needles 7 are not stitched into the fleece web, the horizontal movement component of the needle bar carrier is opposite to the fleece web transport direction.

It must be noted that the invention illustrated by means of the example of machines needling on one side can also be carried out in double needle machines, in which the needles of two opposite needle units stitch into a fiber fleece web simultaneously or alternatingly from both sides. Furthermore, the invention can also be used in needle machines that comprise a plurality of needling zones arranged at different locations in the machine frame, as e.g. described in U.S. Pat. No. 3,508,307. In machines of that kind, a drive of the kind described above is associated to each needle bar. Except for the needle stitch-in movement perpendicular to the fiber fleece web, the needle bar also causes an oscillating movement parallel to the fiber fleece web in and possible laterally to the transport direction of the fiber fleece web.

Furthermore, it must be explained that the needle machine according to the invention may also be a pattern needling machine or a structuring needling machine, as e.g. described in U.S. Pat. No. 5,144,730 (Dilo). By means of such a machine, patterned, textile needle felt or needle felt velour webs can be manufactured consisting of a textile carrier web and of a textile fiber material, wherein the fibers of said fiber material differ from the fibers of the carrier web with respect to color and/or shape and/or material and/or degree of fineness and/or orientation, and are applied onto the back side of the carrier web lying on the support, and are pressed through the carrier web until visible to the front side lying on the support by means of the needles. In the products manufactured in this manner, the stitching pattern is improved by the measures of the invention and productivity is increased.

Finally, it is mentioned that the invention can also be used in such needle machines in which the support for the fiber fleece web in the machine frame is movably supported to be moved perpendicularly to the supporting surface of the support and is connected with a drive by means of which the support can be cyclically raised and lowered according to a predetermined program to change the stitching depth of the needles into the fiber fleece web and to thereby cause certain desired patterns in the product, e.g. a pattern of fiber poles protruding over the surface of the product, as described in EP 0 183 952 A1 or EP 0 411 647 A1.

In such a machine, the stripper plate 8 and the support 9 are supported vertically movably within the machine frame 1. This embodiment is shown in FIG. 4 according to which the second guide columns 65 are attached or formed at a common carrier 66 which is vertically adjustably guided in the machine frame at supports 67 and which is supported by a hydraulic actuator drive 68 by the aid of which the carrier 66 can be moved up and down according to a predetermined, freely selectable program.

Figure 11:
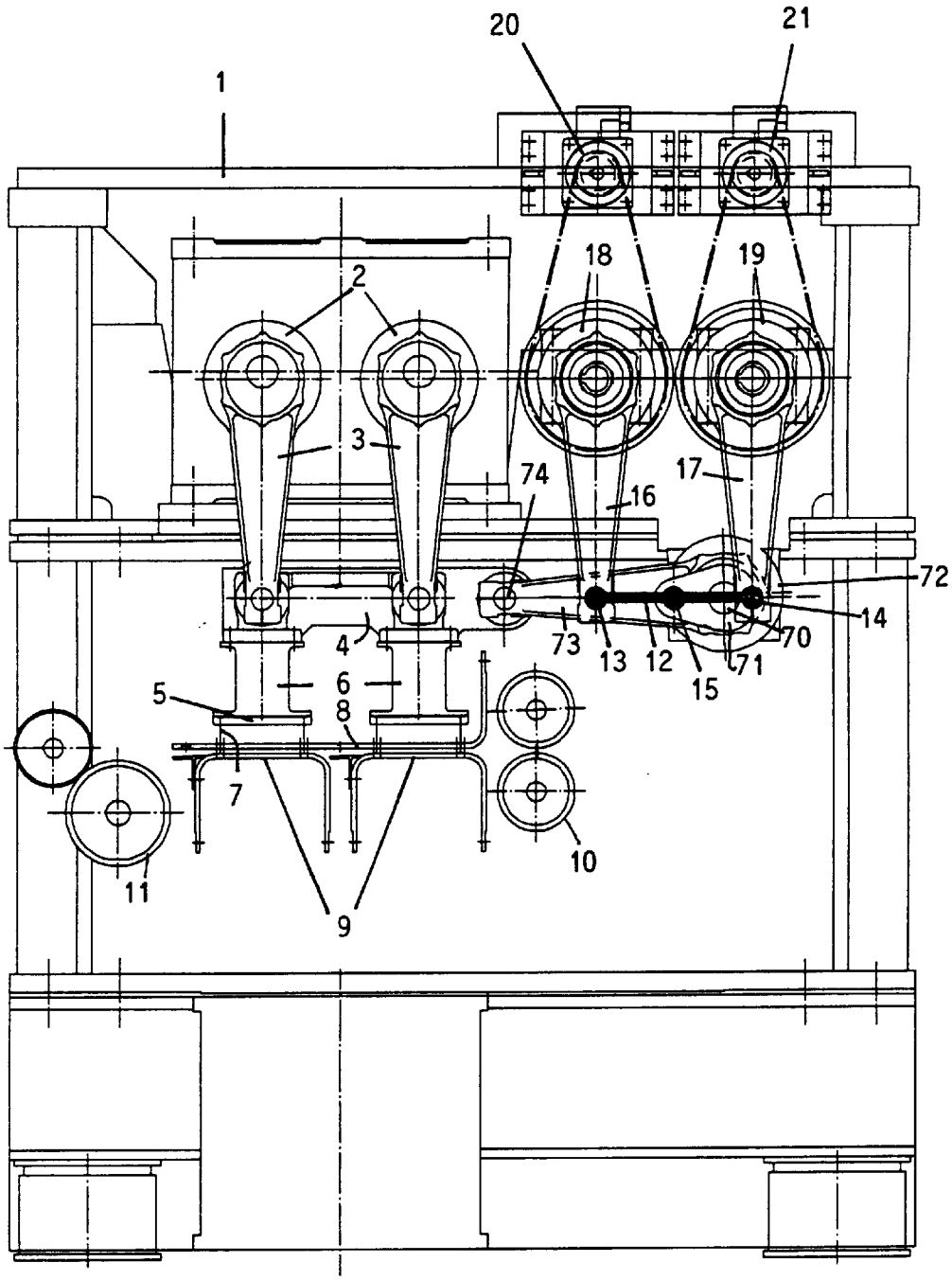
FIG. 11 is a partial view of a further alternative of a means for transferring the horizontally aligned movement force onto the needle bar carrier.

The embodiment of FIG. 11 shows an alternative for the power transmission from the second drive means to the needle bar carrier. To explain the differences of this power transmission to the already described power transmission, it is briefly referred to FIG. 1 to 5.

As already explained, it is required in large needle bar lengths that the force that provides the needle bar with a horizontal movement, engages at a plurality of positions at the needle bar. Accordingly, in the embodiments according to FIG. 1 and 2, a plurality of eccentric and connecting rod pairs are required which are arranged along the needle bar. According to FIG. 3 and 4, a plurality of links 24 are required, which engage at longitudinally spaced positions at the needle bar carrier. The same applies for the embodiments according to FIG. 5 and 6, in which besides a link extending in parallel to the needle bar carrier, a plurality of links 24 are required. In these embodiments, the mechanical effort is relatively high, and in the solutions according to FIG. 3 to 6, the mechanic masses, that have to be reciprocated are relatively high.

In contrast thereto, FIG. 11 shows an embodiment, in which by means of one single eccentric and connecting rod pair 18, 19, and 16, 17, respectively, with a coupling bridge 12 coupled thereto, a shaft 70 extending in parallel to the needle bar carrier 4 is put into a reciprocating rotary movement. For this purpose, the coupling bridge 12 on its third hinge point 15 is connected to the end of a lever 71 rigidly connected to the shaft 70. On the shaft 70 fixedly supported in the machine frame 1 at a plurality of positions spaced along the needle bar carrier 4, eccentrics 72 are arranged on which connecting rods 73 are supported, the free end of which being pivotally connected to the needle bar carrier 4 at respective hinge points 74.

The advantage of this solution is that the shaft 70 is put into a reciprocating movement, for which a lower moment of inertia has to be overcome than for the movement of e.g. the link 25 in the embodiment according to FIG. 5. For transforming the rotary movement of the shaft 21 into a reciprocating linear movement, and the transfer of the same onto the needle bar carrier 4, one single connecting rod 73 per engagement location is required in contrast to the solutions according to FIG. 1 to 3, whereby the moved masses are also reduced.

The stroke of the horizontal movement of the needle bar carrier 4 and the time position of the horizontal movement of the needle bar carrier 4 with respect to the vertical movement thereof, are adjustable in the embodiment according to FIG. 11 in the same manner as in the embodiments according to FIG. 1 to 6. Thus, a description in this respect is not necessary.

We claim:

1. A needle machine for needling a non-woven fiber fleece web, comprising at least one support for supporting a fiber fleece web to be needled, at least one movable needle bar equipped with a plurality of needles, a driving arrangement for causing said needle bar to have an oscillating motion, said driving arrangement including a first drive means connected to the needle bar and imparting on same a first movement component extending perpendicularly to the support, a second drive means connected to the needle bar and imparting on same a second movement component extending in parallel to the support, and a means for varying a movement stroke of the second movement component, said second drive means comprising two eccentric shafts, said eccentric shafts being driven at the same speed and each comprising an eccentric section with a connecting rod converting a rotating movement of the associated eccentric section into a linearly oscillating movement, said machine further comprising a coupling bridge having first and second hinge points spaced apart from one another to which the linearly oscillating movements of both connecting rods are supplied, and which coupling bridge comprises a third hinge point situated between said first and second hinge points, said third hinge point being pivotally connected to the needle bar by coupling means, and control means for varying the movement of the second movement component which acts on the second drive means in a manner that a mutual rotary angle position of the two eccentric shafts is varied.

2. A needle machine according to claim 1, in which the first and second drive means comprise drive motors that are independent from one another.

3. A needle machine according to claim 1, in which the eccentric shafts of the second drive means are driven at a programmable mutual phase relation which can be varied in time.

4. A needle machine according to claim 2, in which the eccentric shafts of the second drive means are driven at a programmable mutual phase relation which can be varied in time.

5. A needle machine according to claim 3, in which local rotary angle speeds of the eccentric shafts of the second drive means are variable with respect to one another by the control means.

6. A needle machine according to claim 4, in which local rotary angle speeds of the eccentric shafts of the second drive means are variable with respect to one another by the control means.

7. A needle machine according to claim 1, in which a first one of the eccentric shafts associated to the second drive means is identical to the eccentric shaft belonging to the first drive means or is coupled to such eccentric shaft of the first drive means.

8. A needle machine according to claim 1, wherein (a) the second drive means comprises two eccentric shafts belonging only to said second drive means, (b) the connecting rods associated to the eccentric shafts have free ends that are connected to the first and second hinge points of the coupling bridge, and (c) the means for mutually adjusting the eccentric shaft rotary angle position is coupled to said eccentric shafts.

9. A needle machine according to claim 8, in which an independent drive motor is associated to each eccentric shaft of the second drive means, and the means for adjusting the mutual rotary angle position of said eccentric shafts acts on at least one of these drive motors.

10. A needle machine according to claim 8, in which the drive motors of the second drive means are controlled such that a speed of the horizontal movement component of the needle bar caused by the second drive means is constant in at least a portion of the movement.

11. A needle machine according to claim 8, in which the eccentric shafts of the second drive means are coupled to one another by means of a toothed gearing, said toothed gearing being selectively engageable and disengageable for an adjustment of the mutual rotary angle position of said eccentric shafts.

12. A needle machine according to one of claims 8 to 11, in which the coupling bridge is connected to the needle bar through a rocker arm pivotally connected to the coupling bridge and a link pivotally connected to the rocker arm and the needle bar.

13. A needle machine according to one of claims 8 to 11, in which the coupling bridge is connected to the needle bar at the third hinge point of said coupling bridge by a hinge pin.

14. A needle machine according to one of claims 8 to 11, in which the eccentric shafts of the second drive means rotate in opposite directions to one another.

15. A needle machine for needling a non-woven fiber fleece web, comprising at least one support for supporting a fiber fleece web to be needled, at least one movable needle bar equipped with a plurality of needles, said needle bar being put into an oscillating movement, and a driving arrangement for the needle bar, comprising a first drive means, which is connected to the needle bar and imparts on same a first movement component extending perpendicularly to the support, a second drive means connected to the needle bar and imparting on same a second movement component extending parallel to the support, and a means for varying a movement stroke of the first movement component, the second drive means and comprising an eccentric shaft having an eccentric section a connecting rod rotatably supported thereon, and a rocker arm having first and second legs, said connecting rod having a free end which is pivotally connected to a first leg of the rocker arm at a first hinge point thereof, a second leg of the rocker arm being pivotally supported at a second hinge point thereof in a frame of the needle machine, a third hinge point located between said first and second hinge points of the rocker arm and pivotally connected by a link extending substantially parallel to the support of the fiber fleece web to be needled in the needle machine, to the needle bar, wherein a distance exists between the first hinge point and the second hinge point, said distance being variable along the first leg of the rocker arm.

16. A needle machine according to one of claims 1 to 11 or 15, in which the horizontal component extends opposite to a transport direction of the fiber fleece web through the needle machine.

17. A needle machine according to claim 16, in which the second drive means is pivotally connected to the needle bar at a plurality of positions spaced along the needle bar.

18. A needle machine according to one of claims 1 to 11 or 15, in which an actuator is associated to the needle bar, said actuator being adapted to adjust the needle bar transversely to a transport direction of the fiber fleece web through the needle machine by means of a transverse link.

19. A needle machine according to claim 18 in which the actuator includes an electric linear motor.

20. A needle machine according to claim 18, in which the actuator includes a servo-hydraulic drive means.

21. A needle machine according to claim 18, in which the actuator drive comprises two synchronously driven eccentric shafts on which connecting rods are supported, said connecting rods having free ends connected to a coupling bridge, wherein said coupling bridge has a central hinge point to which the transverse link is attached, wherein the mutual rotary phase relation of the eccentric shafts is variable.

22. A needle machine according to 20, in which the actuator drive comprises two synchronously driven eccentric shafts on which connecting rods are supported which have free ends that are connected to a coupling bridge having a central hinge point at which the transverse link is attached, wherein the mutual rotary phase relation of the eccentric shafts is variable.

23. A needle machine according to claim 18, in which the actuator is controlled by a stochastically operating random generator.

24. A needle machine according to claim 18, in which the actuator is controlled by a control generator delivering a cyclically operating control program.

25. A needle machine according to claim 18, in which the actuator includes a cam follower, which slides on an eccentric which is driven by the main motor.

26. A needle machine according to one of claims 1 to 11 or 15, said needle machine being designed as a double needle machine, comprising at least two needle bars driven synchronously to one another, said needle bars working the fiber fleece web simultaneously or alternately in one needling zone, wherein a driving arrangement according to one of the preceding claims is associated to each needle bar.

27. A needle machine according to one of claims 1 to 11 or 15, said needle machine being designed as a pattern or structuring machine, by means of which patterned, textile needle felt or needle felt velour webs are manufactured which consist of a textile carrier web and a textile fiber material which is applied onto a rear back side of the carrier web lying on the support and having fibers which are needled by the needles through the carrier web until becoming visible on a front side of the textile carrier web lying on the support.

28. A needle machine according to one of claims 1 to 11 or 15, said needle machine comprising at least two needling zones in which the fiber fleece web is needled either from one side or from both sides by means of at least two needle bars provided each with needles, wherein said driving arrangement is coupled to each needle bar.

29. A needle machine according to one of claims 1 to 11 or 15, in which the support is connected with an actuator, by means of which the support can be raised and lowered according to a predetermined program.

30. A needle machine according to one of claims 1 to 11 or 15, said needle machine not comprising at least one of supply and take-up rollers associated to the needling zone, the fiber fleece web being transported through the needle machine by the horizontal movement component of the needle bar upon the needles thereof being stitched into the fiber fleece web.

31. A needle machine according to one of claims 1 to 11 or 15, in which at least one of a supply and take-up roller pair arranged adjacent the support are adjustable to a gap width that is greater than a thickness of the fiber fleece web transported through said gap.

32. A needle machine according to one of claims 1 to 11 or 15, in which a stripper plate and the support are movably supported in a machine frame and are coupled with the second drive means so as to perform a horizontal movement following the horizontal movement of the needle bar.

33. A needle machine according to one of claims 1 to 11 or 15, in which the coupling bridge of the second drive means is connected through a lever with a shaft extending along the needle bar, said shaft having a plurality of eccentrics spaced along the needle bar, on each of which a connecting rod is supported having a free end hingedly connected to the needle bar.

34. A needle machine according to claim 19, in which the actuator drive comprises two synchronously driven eccentric shafts on which connecting rods are supported which have free ends that are connected to a coupling bridge having a central hinge point at which the transverse link is attached, wherein the mutual rotary phase relation of the eccentric shafts is variable.

* * * * *